United States Patent [19]

Krause et al.

[11] 4,377,002

[45] Mar. 15, 1983

[54] X-RAY DIAGNOSTIC GENERATOR COMPRISING AN INVERTER CIRCUIT FEEDING THE HIGH VOLTAGE TRANSFORMER

[75] Inventors: Hartmut Krause, Erlangen; Gerd Seifert, Spardorf, both of Fed. Rep. of Germany

[73] Assignee: Siemens Aktiengesellschaft, Berlin & Munich, Fed. Rep. of Germany

[21] Appl. No.: 288,938

[22] Filed: Jul. 31, 1981

[30] Foreign Application Priority Data

Sep. 11, 1980 [DE] Fed. Rep. of Germany ..... 3034286

[51] Int. Cl.[3] ..... H05G 1/66

[52] U.S. Cl. ..... 378/093; 378/105

[58] Field of Search ..... 378/93, 105

[56] References Cited

U.S. PATENT DOCUMENTS 2,149,164 2/1939 Daumann ..... 378/93

4,213,049 7/1980 Seifert ..... 378/105

4,247,776 1/1981 Seifert ..... 378/93

FOREIGN PATENT DOCUMENTS 2834561 2/1980 Fed. Rep. of Germany .

*Primary Examiner*—Alfred E. Smith

*Assistant Examiner*—T. N. Grigsby

*Attorney, Agent, or Firm*—Hill, Van Santen, Steadman, Chiara & Simpson

[57] ABSTRACT

In an exemplary embodiment a rotary anode motor is likewise supplied by the inverter circuit which is in the form of a full bridge with two pairs of alternately closable electronic switches. In one bridge diagonal the load (e.g. the x-ray tube) is disposed, while a d.c. voltage source is connected to the other bridge diagonal. The rotary anode motor is capable of connection, via a switch, to a connection point at one side of the load diagonal, and the bridge-half at the opposite side of the load diagonal is capable of being maintained in an open circuit condition during motor operation.

1 Claim, 1 Drawing Figure

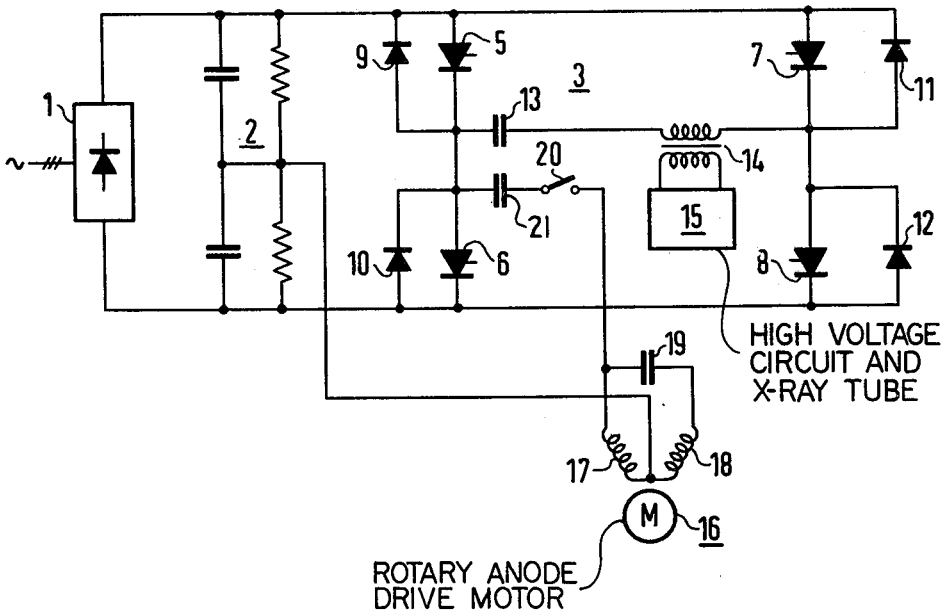
1
2
3
5
6
7
8
9
10
11
12
13
14
15
16
17
18
19
20
21
M
HIGH VOLTAGE CIRCUIT AND X-RAY TUBE
ROTARY ANODE DRIVE MOTOR

X-RAY DIAGNOSTIC GENERATOR COMPRISING AN INVERTER CIRCUIT FEEDING THE HIGH VOLTAGE TRANSFORMER

BACKGROUND OF THE INVENTION

The invention relates to an x-ray diagnostic generator comprising a mains (or power) rectifier, an inverter circuit fed by the latter, the output voltage of said inverter circuit being supplied to a high voltage transformer, an x-ray tube, connected to the output of the high voltage transformer, with a rotary anode and a drive circuit for the rotary anode motor designed as an induction motor, in which the rotary anode motor is likewise supplied by the inverter circuit.

An x-ray diagnostic generator of this type is described in the German OS No. 2,815,893 (U.S. Pat. No. 4,247,776). In the case of this x-ray diagnostic generator, the inverter circuit is utilized twice; namely, once for feeding the x-ray tube and, on the other hand, for feeding the rotary anode motor. A simple construction thereby results. In the German OS No. 2,815,893 a half-bridge inverter circuit is presented whose output voltage can be selectively supplied either to the rotary anode motor or to the x-ray tube. A radiograph takes place after the rotary anode is brought up to speed and after the inverter has been disconnected from the rotary anode motor so that the rotary anode is running as a result of its momentum. It is also known from the cited German OS No. 2,815,893 to connect the x-ray tube and the rotary anode motor in parallel with the inverter circuit output so that the rotary anode motor will be driven also during a radiograph.

SUMMARY OF THE INVENTION

The object underlying the invention resides in designing an x-ray diagnostic generator of the type initially cited such that the current load of the switching means for the connection of the rotary anode motor to the inverter circuit is kept low.

In accordance with the invention this object is achieved in that the inverter circuit is comprised of a full bridge arrangement with two pairs of alternately closable electronic switches, in the one diagonal of which the load is disposed and to the other diagonal of which a d.c. voltage source is connected, and in that the rotary anode motor is connectable, via a switch, to a connection point at one side of the load diagonal, and the bridge-half at the opposite side of the load diagonal is capable of disconnection during motor operation. With this embodiment, the switch, during motor operation, need only take over the low motor current.

The invention shall be explained in greater detail in the following on the basis of an exemplary embodiment illustrated on the accompanying drawing sheet; and other objects, features and advantages will be apparent from this detailed disclosure and from the appended claims.

BRIEF DESCRIPTION OF THE DRAWING

The single FIGURE is an electric circuit diagram for illustrating an exemplary embodiment of the present invention.

DETAILED DESCRIPTION

In the drawing, a three-phase current rectifier 1 is illustrated which, via a filter network 2, supplies an inverter circuit 3 which is in the form of a full bridge with four alternately closable thyristors 5 through 8 which are bridged by free-running diodes 9 through 12. The d.c. voltage is here supplied to the one diagonal of the inverter circuit 3, whereas, in the other diagonal, an oscillatory circuit is disposed which is comprised of a capacitor 13 and a high voltage transformer 14 to whose output the load 15, i.e. an x-ray tube, is connected. The x-ray tube exhibits a rotary anode whose motor 16 is designed as an a.c. current induction motor with a main winding 17 and an auxiliary winding 18. The auxiliary winding 18 is connected in series with a phase shifting capacitor 19. The capacitor 19 and the main winding 17 can be connected via a switch 20 and a capacitor 21 to the connection point of a diagonal of the inverter circuit 3.

If a radiograph is to be made, first only the left branch of the inverter circuit 3 is activated by a control circuit; i.e., only the thyristors 5 and 6 are alternately ignited. The right branch is not activated so that the thyristors 7 and 8 remain highly resistive. The switch 20 is here closed so that the rotary anode motor 16 is energized. The ignition pulses for the thyristors 5 and 6 are generated in their chronological sequence corresponding to the desired feed frequency for the rotary anode motor 16. The switch 20 need only be dimensioned corresponding to the maximum current required by the motor system.

If the x-ray tube is to be switched on, the switch 20 is opened and a radiograph proceeds in the case of a running-down (coasting) rotary anode. In order to feed the x-ray tube, the inverter circuit 3 operates in full bridge circuit, i.e., the thyristors 5 and 8, as well as 7 and 6, are alternately ignited.

In the exemplary embodiment an oscillatory inverter circuit with a capacitor 13 and an inductance, which is formed by the high voltage transformer 14, is illustrated. The described principle, however, applies in general to all other known inverter circuits of the full bridge type.

It will be apparent that many modifications and variations may be effected without departing from the scope of the novel concepts and teachings of the present invention.

We claim as our invention:

1. An x-ray diagnostic generator comprising a d.c. voltage source having a power rectifier, an inverter circuit fed by said d.c. voltage source, a high voltage transformer connected with said inverter and having an output, an x-ray tube connected to the output of the high voltage transformer, a rotary anode drive circuit including a rotary anode motor designed as an induction motor, in which the rotary anode motor is likewise fed by the inverter circuit, characterized in that the inverter circuit (3) comprises a full bridge arrangement with two pairs of alternately closable electronic switches (5 through 8), having a first diagonal including said high voltage transformer, and having a second diagonal connected with said d.c. voltage source (1, 2), a switch (20), said full bridge arrangement including first and second current flow paths each including one of said electronic switches and an intervening connection point, and means for connecting the rotary anode motor (16) via said switch (20) to said connection point of said first and second current flow paths to supply alternating current to said rotary anode motor while said first diagonal is deenergized, and means for energizing said first diagonal with alternating current to energize said high voltage transformer.

* * * * *